US008654014B2

(12) United States Patent
Ling et al.

(10) Patent No.: US 8,654,014 B2
(45) Date of Patent: Feb. 18, 2014

(54) INVERTED-F ANTENNA AND WIRELESS COMMUNICATION APPARATUS USING THE SAME

(75) Inventors: Ching-Wei Ling, Tainan County (TW); Chih-Pao Lin, Zhubei (TW)

(73) Assignee: Realtek Semiconductor Corp., Hsinchu (TW)

( * ) Notice: Subject to any disclaimer, the term of this patent is extended or adjusted under 35 U.S.C. 154(b) by 264 days.

(21) Appl. No.: 13/179,181

(22) Filed: Jul. 8, 2011

(65) Prior Publication Data

US 2012/0007784 A1 Jan. 12, 2012

(30) Foreign Application Priority Data

Jul. 9, 2010 (TW) ..... 99122701 A

(51) Int. Cl.
*H01Q 1/24* (2006.01)

(52) U.S. Cl.
USPC ..... 343/702; 343/700 MS

(58) Field of Classification Search
USPC ..... 343/700 MS, 702
See application file for complete search history.

(56) References Cited

U.S. PATENT DOCUMENTS

| | | | | |
|---|---|---|---|---|
| 6,476,769 | B1 * | 11/2002 | Lehtola | 343/702 |
| 6,836,249 | B2 * | 12/2004 | Kenoun et al. | 343/700 MS |
| 6,985,108 | B2 * | 1/2006 | Mikkola et al. | 343/700 MS |
| 7,106,259 | B2 | 9/2006 | Tseng et al. | |
| 7,489,278 | B2 * | 2/2009 | Huang | 343/702 |
| 8,390,523 | B2 * | 3/2013 | Wang et al. | 343/702 |
| 8,421,688 | B2 * | 4/2013 | Tu | 343/702 |
| 2009/0040110 | A1 | 2/2009 | Chien et al. | |
| 2009/0195478 | A1 | 8/2009 | Tsai et al. | |

* cited by examiner

*Primary Examiner* — Tan Ho
(74) *Attorney, Agent, or Firm* — Birch, Stewart, Kolasch & Birch, LLP

(57) ABSTRACT

An inverted-F antenna is disclosed including: a radiating body including a plurality of radiating portions, and some of the radiating portions located on a same plane; a shorting element extending outward from the radiating body and forming a first predetermined included angle with one of the radiating portions; a feeding element extending outward from the radiating body and forming a second predetermined included angle with one of the radiating portions; and a protrusion extending outward from the radiating body and forming a third predetermined included angle with one of the radiating portions; wherein at least one of the first, second, and third predetermined included angles is substantially a right angle.

30 Claims, 9 Drawing Sheets

INVERTED-F ANTENNA AND WIRELESS COMMUNICATION APPARATUS USING THE SAME

CROSS-REFERENCE TO RELATED APPLICATIONS

This application is based upon and claims the benefit of priority to Taiwanese Patent Application No. 099122701, filed on Jul. 9, 2010; the entire content of which is incorporated herein by reference for all purpose.

BACKGROUND

The present disclosure generally relates to an antenna, and more particularly, to an inverted-F antenna for use in a wireless communication apparatus.

Antenna is an important component for a wireless communication apparatus, but it often occupies considerable area and volume of the circuitry module. With the increasing demand on lighter, thinner, and smaller wireless communication devices, the volume of the antenna has to be further reduced for meeting the trend of device miniaturization.

In related art, an inverted-F antenna (IFA) is widely utilized in many network cards, mobile phones, and other portable wireless devices due to it possesses good omnidirectional radiation patterns.

However, the radiating body length of the inverted-F antenna has to be one quarter wavelength of the radio signal to be received/transmitted by the antenna. It is thus difficult to reduce the overall volume of the circuitry module because of the above restriction on the radiating body length of the inverted-F antenna.

SUMMARY

In view of the foregoing, it is appreciated that a substantial need exists for antenna structure that possesses good radiation characteristic, compact in size, and has merit of lower cost.

An exemplary embodiment of an inverted-F antenna is disclosed comprising: a radiating body comprising a plurality of radiating portions, and some of the radiating portions located on a first plane; a shorting element extending outward from the radiating body and forming a first predetermined included angle with one of the radiating portions; a feeding element extending outward from the radiating body and forming a second predetermined included angle with one of the radiating portions; and a protrusion extending outward from the radiating body and forming a third predetermined included angle with one of the radiating portions; wherein at least one of the first, second, and third predetermined included angles is substantially a right angle.

An exemplary embodiment of a wireless communication apparatus is disclosed comprising: a circuit board comprising a first connection portion, a second connection portion, and a grounded plane; and an inverted-F antenna comprising: a radiating body comprising a plurality of radiating portions, some of the radiating portions located on a first plane, and at least one of the radiating portions not located on the first plane; a shorting element extending outward from the radiating body, the shorting element contacting with the first connection portion and the grounded plane, and forming a first predetermined included angle with one of the radiating portions; a feeding element extending outward from the radiating body, the feeding element contacting with the second connection portion and forming a second predetermined included angle with one of the radiating portions; and a protrusion extending outward from one of the radiating portions, the protrusion forming a third predetermined included angle with one of the radiating portions, and not contacting with the grounded plane.

It is to be understood that both the foregoing general description and the following detailed description are exemplary and explanatory only and are not restrictive of the invention, as claimed.

DETAILED DESCRIPTION

Reference will now be made in detail to embodiments of the invention, which are illustrated in the accompanying drawings. The same reference numbers may be used throughout the drawings to refer to the same or like parts or components.

Certain terms are used throughout the description and following claims to refer to particular components. As one skilled in the art will appreciate, vendors may refer to a component by different names. This document does not intend to distinguish between components that differ in name but not in function. In the following description and in the claims, the terms "include" and "comprise" are used in an open-ended fashion, and thus should be interpreted to mean "include, but not limited to . . . ."

Figure 1:
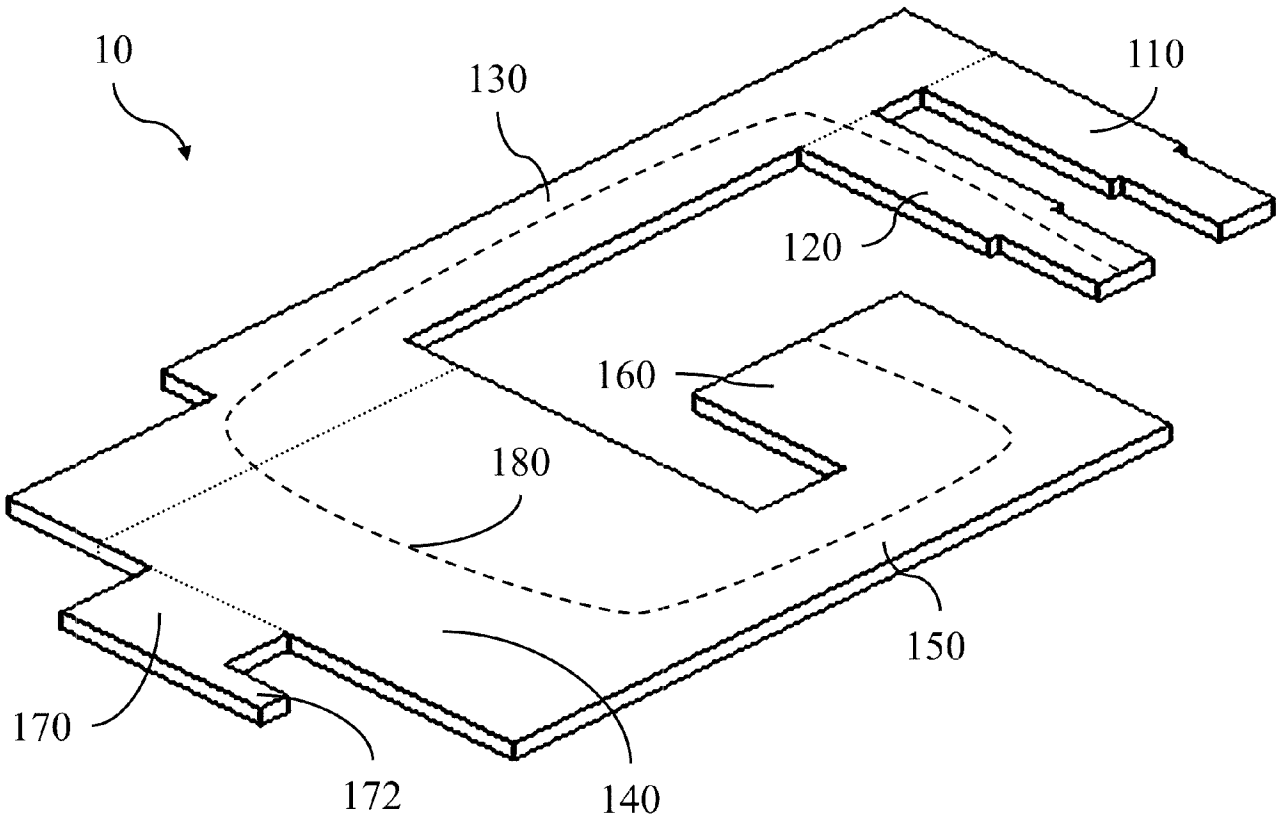
FIG. 1 is a simplified schematic diagram of a planar inverted-F antenna according to an exemplary embodiment.

Please refer to FIG. 1, which shows a simplified schematic diagram of a planar inverted-F antenna (PIFA) 10 according to an exemplary embodiment. The antenna 10 comprises a radiating body, and a shorting element 110, a feeding element 120, and a protrusion 170 which extend outward from the radiating body. The protrusion 170 comprises a positioning member 172 extending outward therefrom. In this embodiment, the radiating body of the antenna 10 comprises a first radiating portion 130, a second radiating portion 140, a third radiating portion 150, and a fourth radiating portion 160. In FIG. 1, a virtual path 180 schematically illustrates the equivalent current path of the radiating body of the antenna 10, and the length of the virtual path 180 may represent the length of the equivalent current path of the radiating body, or may be regarded as the total length of the radiating body of the antenna 10.

In implementations, the gap between the shorting element 110 and the feeding element 120 may be manipulated to adjust the input impendence of the antenna 10 in order to achieve better impendence matching.

The respective parts of the antenna 10 described above may be formed separately by conductive materials and then assembled with together. Alternatively, respective parts of the antenna 10 may be made integrally by stamping or cutting a single metal sheet so as to reduce the complexity and cost of manufacture.

Before assembling the antenna 10 with the circuit board of a wireless communication apparatus, the antenna 10 may be bent to an appropriate shape to increase its structural rigidity.

Figure 2:
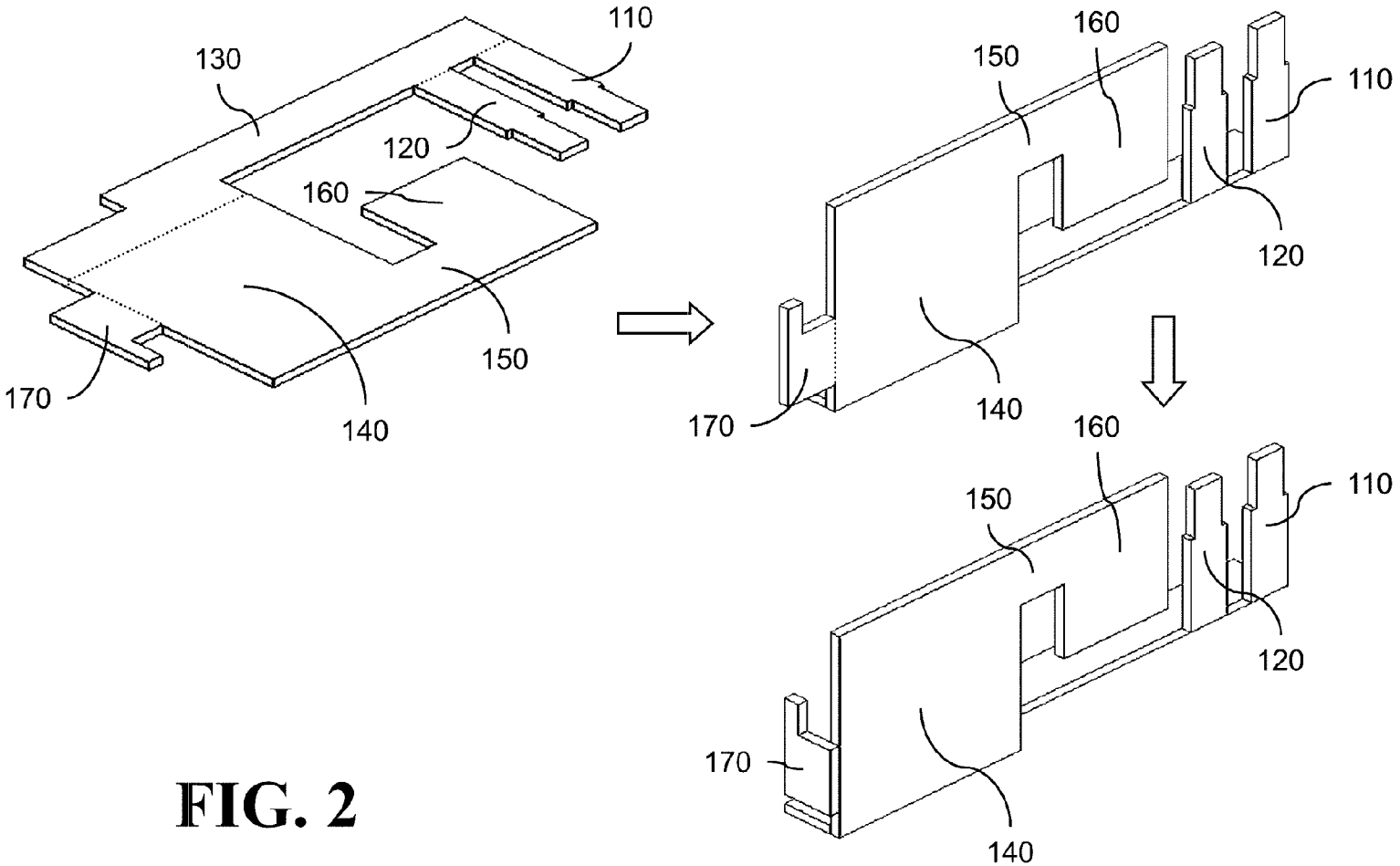
FIG. 2 is a schematic diagram illustrating the fabrication of the antenna of FIG. 1 according to an exemplary embodiment.

FIG. 2 is a schematic diagram illustrating the fabrication of the antenna 10 according to an exemplary embodiment. As shown in FIG. 2, the shorting element 110, the feeding element 120, and the second radiating portion 140 of the antenna 10 may be respectively bent to have a predetermined included angle (e.g., an angle between 80~100 degrees) with the first radiating portion 130, or to be substantively perpendicular to the first radiating portion 130. Then, the protrusion 170 is bent to have a predetermined included angle (e.g., an angle between 80~100 degrees) with the second radiating portion 140, or to be substantively perpendicular to the second radiating portion 140.

In this embodiment, the second radiating portion 140, the third radiating portion 150, and the fourth radiating portion 160 are located on the same plane under normal operating condition, and substantively parallel to both the shorting element 110 and the feeding element 120. That is, the shorting element 110 and the feeding element 120 are not located on the plane on which the second radiating portion 140, the third radiating portion 150, and the fourth radiating portion 160 are located. On the other hand, the first radiating portion 130 of this embodiment is not located on the plane on which the second radiating portion 140, the third radiating portion 150, and the fourth radiating portion 160 are located under normal operating condition. Instead, the first radiating portion 130 is substantially perpendicular to the second radiating portion 140, the third radiating portion 150, and the fourth radiating portion 160. As a result, the antenna 10 has a three-dimensional structure under normal operating condition to greatly enhance its structural rigidity and stability, so that the antenna 10 would not deform during assembling and operation.

Figure 3:
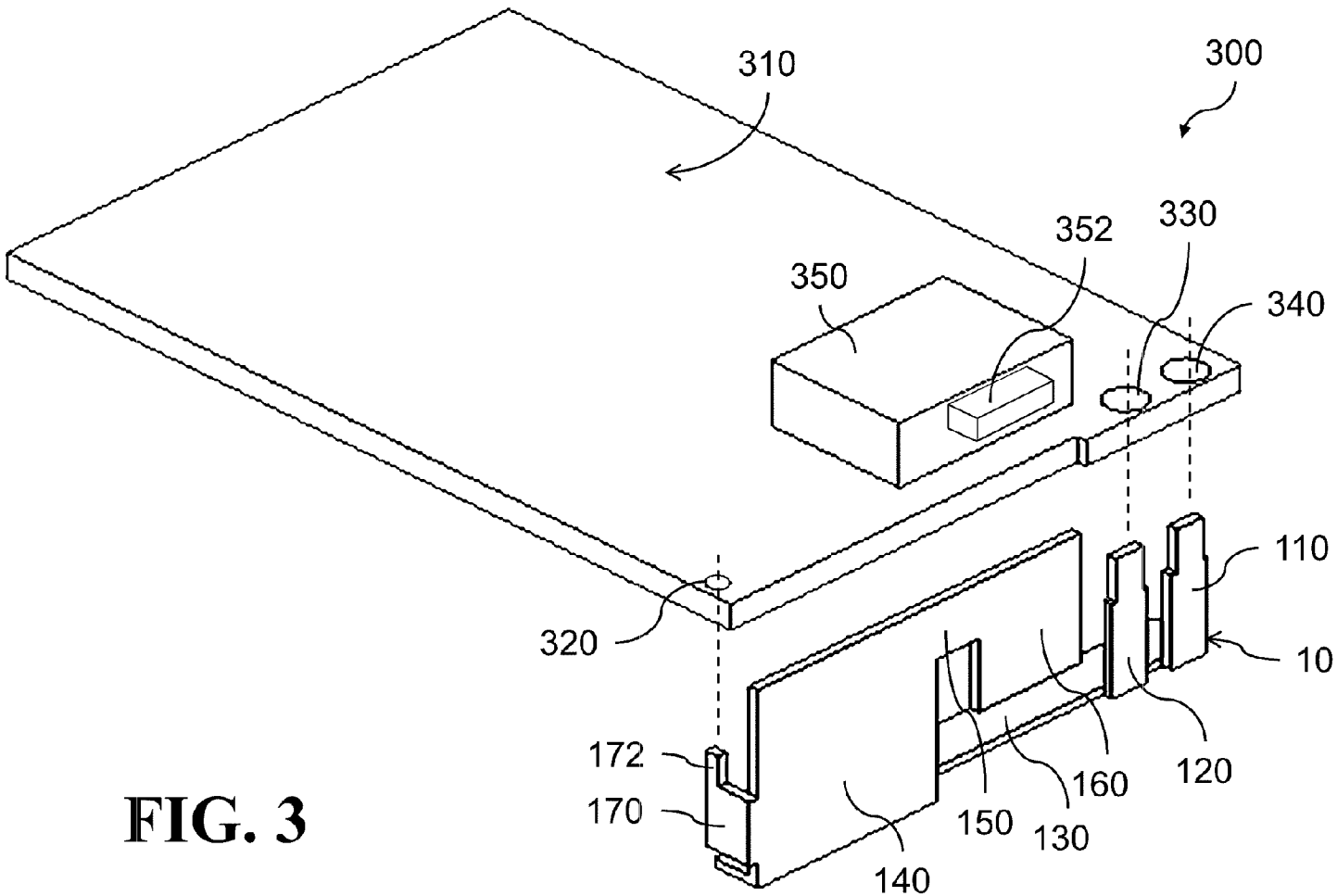
FIG. 3 is a simplified schematic diagram of a wireless communication device using the antenna of FIG. 1 according to an exemplary embodiment.
Figure 4:
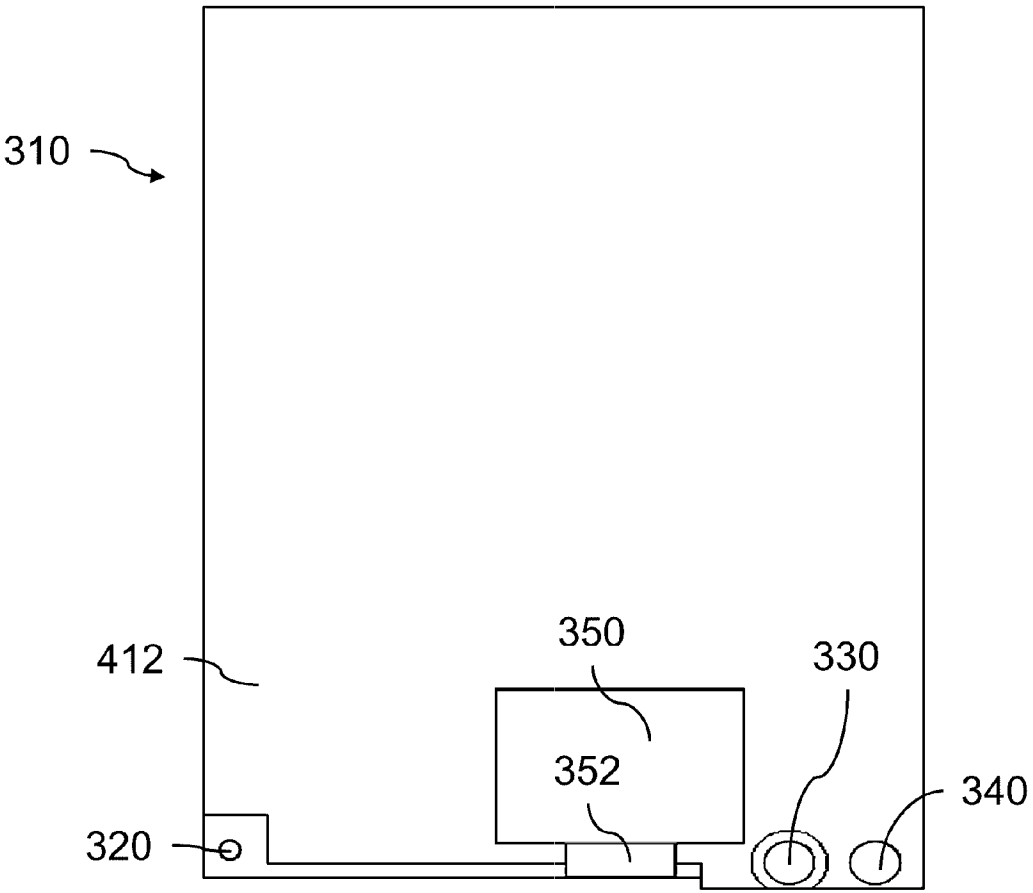
FIG. 4 is a top-view of the wireless communication device of FIG. 3.

Please refer to FIG. 3 and FIG. 4. FIG. 3 shows a simplified schematic diagram of a wireless communication device 300 using the antenna 10 according to an exemplary embodiment. FIG. 4 illustrates a top-view of the wireless communication device 300. In addition to the antenna 10, the wireless communication device 300 further comprises a circuit board 310, three connection portions 320, 330, and 340, and a button socket 350. The circuit board 310 further comprises a grounded plane 412, and the button socket 350 is provided with a push-button 352. For the sake of brevity, other components of the circuit board 310 are omitted in FIG. 3 and FIG. 4.

The connection portions 320, 330, and 340 of the circuit board 310 may be implemented with openings for positioning the antenna 10 firmly on the circuit board 310. In one embodiment, the opening 320 is a through hole and its interior surface is not conductive. There is a gap between the opening 320 and the grounded plane 412 so that the positioning member 172 of the protrusion 170 is not conductive with the grounded plane 412 when the positioning member 172 is inserted into or soldered with the opening 320. The interior surface of the opening 330 is coated with conductive materials, such as copper, and there is a gap between the opening 330 and the grounded plane 412 of the circuit board 310. When the feeding element 120 of the antenna 10 is inserted into or soldered with the opening 330, the feeding element 120 transmits the radio signals received by the antenna 10 to appropriated components for further processing. The interior surface of the opening 340 is also coated with conductive materials and connected with the grounded plane 412 of the circuit board 310. Accordingly, when the shorting element 110 of the antenna 10 is inserted into or soldered with the opening 340, the shorting element 110 is conductive with the grounded plane 412.

In one embodiment, when the antenna 10 is assembled with the circuit board 310, the second radiating portion 140, the third radiating portion 150, and the fourth radiating portion 160 of the antenna 10 is substantively perpendicular to the edges of the circuit board 310.

In addition, the position of the fourth radiating portion 160 located in the end of the antenna 10 corresponds to the push-button 352 on the button socket 350. Therefore, when a user wants to press the push-button 352 to activate a particular function of the wireless communication device 300, such as the WPS setting, the user could press the fourth radiating portion 160 of the antenna 10 to indirectly press the push-button 352. In a preferred embodiment, the area of the fourth radiating portion 160 is more than twice of the area of the push-button 352. As a result, the user is able to easily press the push-button 352 indirectly through the fourth radiating portion 160 even if the dimensions of the push-button 352 shrink due to device miniaturization.

In one embodiment, the end of the shorting element 110 and the end of the feeding element 120 are both dimensioned to be ladder-shaped, enabling the antenna 10 to have a predetermined height when assembled with the circuit board 310. In addition, the end of the protrusion 170 may be dimensioned to be ladder-shaped for maintaining the height of the antenna 10 and for increasing the structural stability of the antenna 10 when assembled with the circuit board 310.

In addition to the merit of increasing structural stability, the use of the protrusion 170 also effectively reduces the required size or radiating body length of the antenna 10 under a given operating frequency.

Figure 5:
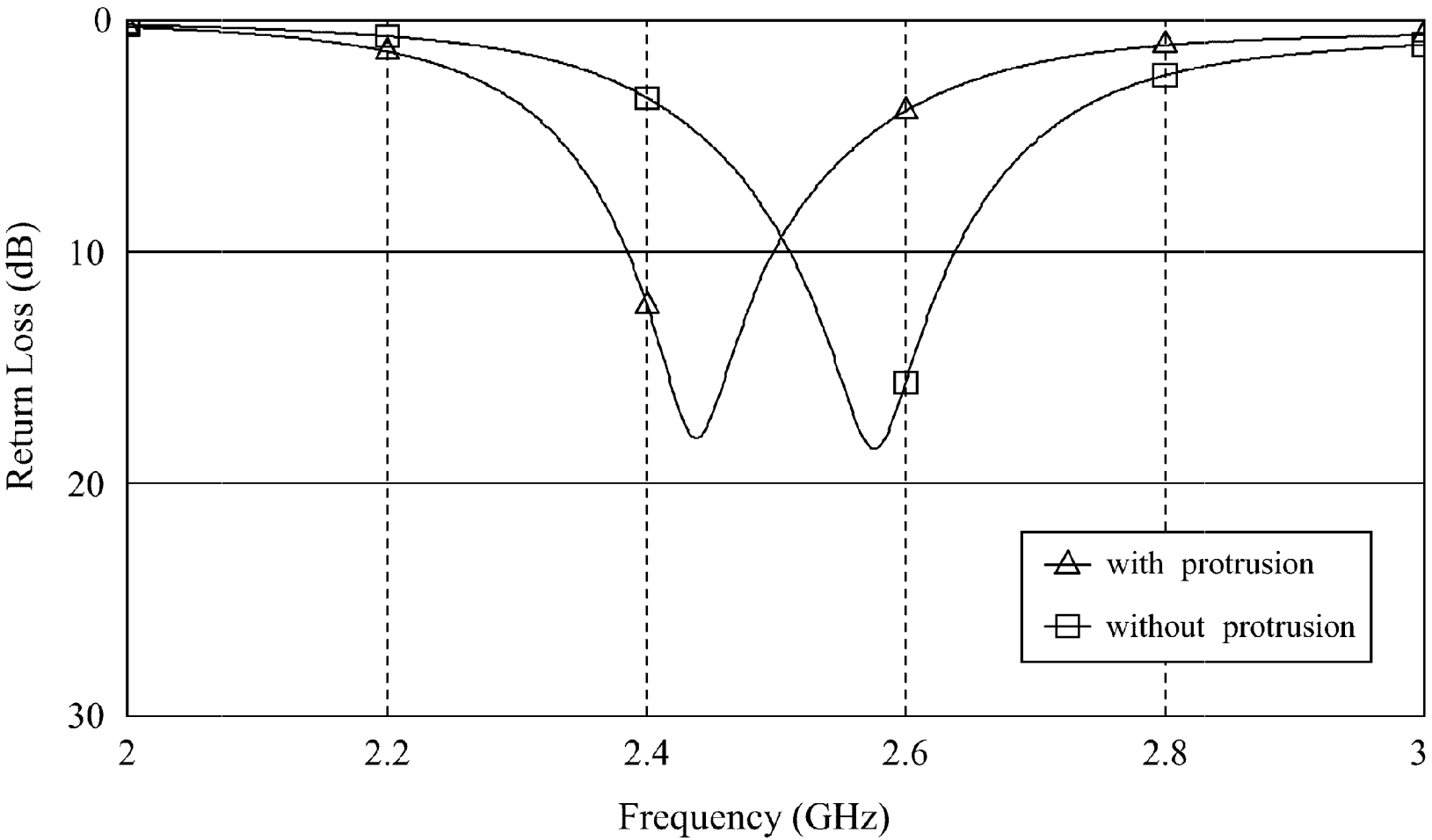
FIG. 5 is a schematic diagram of operating characteristics of the antenna of FIG. 1 with the use of the protrusion and without the use of the protrusion.

Please refer to FIG. 5, which shows the operating characteristics of the antenna 10 with the use of the protrusion 170 and without the use of the protrusion 170. In this embodiment, if the antenna 10 is without the protrusion 170, the operating frequency of the antenna 10 is about 2.58 GHz. On the other hand, if the antenna 10 is with the protrusion 170, e.g., as illustrated in the embodiment of FIG. 1, the operating frequency of the antenna 10 would be reduced to about 2.44 GHz from 2.58 GHz due to the parasitical capacitor effect between the protrusion 170 and the grounded plane 412 of the circuit board 310. In other words, the use of the protrusion 170 reduces the operating frequency of the antenna 10 without substantively changing the total length of equivalent current path (or the total length of the radiating body).

From another aspect, the use of the protrusion 170 effective reduces the required size or radiating body length of the antenna 10 without substantively changing a predetermined operating frequency. Accordingly, the total length of equivalent current path or the total length of the radiating body of the antenna 10 can be designed to be less than one quarter wavelength of the radio signal to be received/transmitted by the antenna 10. For example, in the previous embodiment where the antenna operating frequency is 2.44 GHz, the total length of the radiating body of the antenna 10 (i.e., the length of the virtual path 180 shown in FIG. 1) could be only 25 mm. This is about 16% less than 30 mm, which is the minimum required length in the conventional art. In other words, the total length of equivalent current path of the antenna 10 could be 85%~90% of one quarter wavelength of the radio signal to be received/transmitted by the antenna 10.

In the conventional art, the antenna may encounter the over-bending problem due to the space restriction, which inevitably deteriorates the antenna radiation characteristic. The above drawback in the conventional art could be avoided in this invention as the required size or radiating body length of the antenna 10 can be reduced.

In implementations, by reducing the gap between the grounded plane 412 of the circuit board 310 and the positioning member 172 of the protrusion 170, the parasitical capacitor effect can be increased, enabling the antenna 10 to have a lower operating frequency without changing the total length of the equivalent current path. In addition, if the gap between the grounded plane 412 and the positioning member 172 is given, the parasitical capacitor effect can be increased by increasing the width of the positioning member 172. In this way, the antenna 10 is also allowed to have a lower operating frequency without changing the total length of the equivalent current path. Therefore, the operating frequency of the antenna 10 can be effectively reduced by adjusting the gap between the grounded plane 412 and the positioning member 172 of the protrusion 170, or by changing the width of the positioning member 172. Similarly, the required radiating body length of the antenna 10 under a given operating frequency can be effectively reduced by adjusting the gap between the grounded plane 412 and the positioning member 172 of the protrusion 170, or by changing the width of the positioning member 172.

Additionally, the radiation characteristic of the antenna 10 can be improved by positioning the protrusion 170 on the side of the radiating body where there corresponds to the middle 70% of the equivalent current path of the radiating body. Thus, depending on the length of respective radiating portions of the antenna 10, the protrusion 170 may be positioned on one side of the second radiating portion 140, on one side of the first radiating portion 130, or on one side of the third radiating portion 150. Preferably, the protrusion 170 is positioned on the side of the radiating body where there corresponds to the middle one-third of the equivalent current path of the radiating body of the antenna 10.

Figure 6:
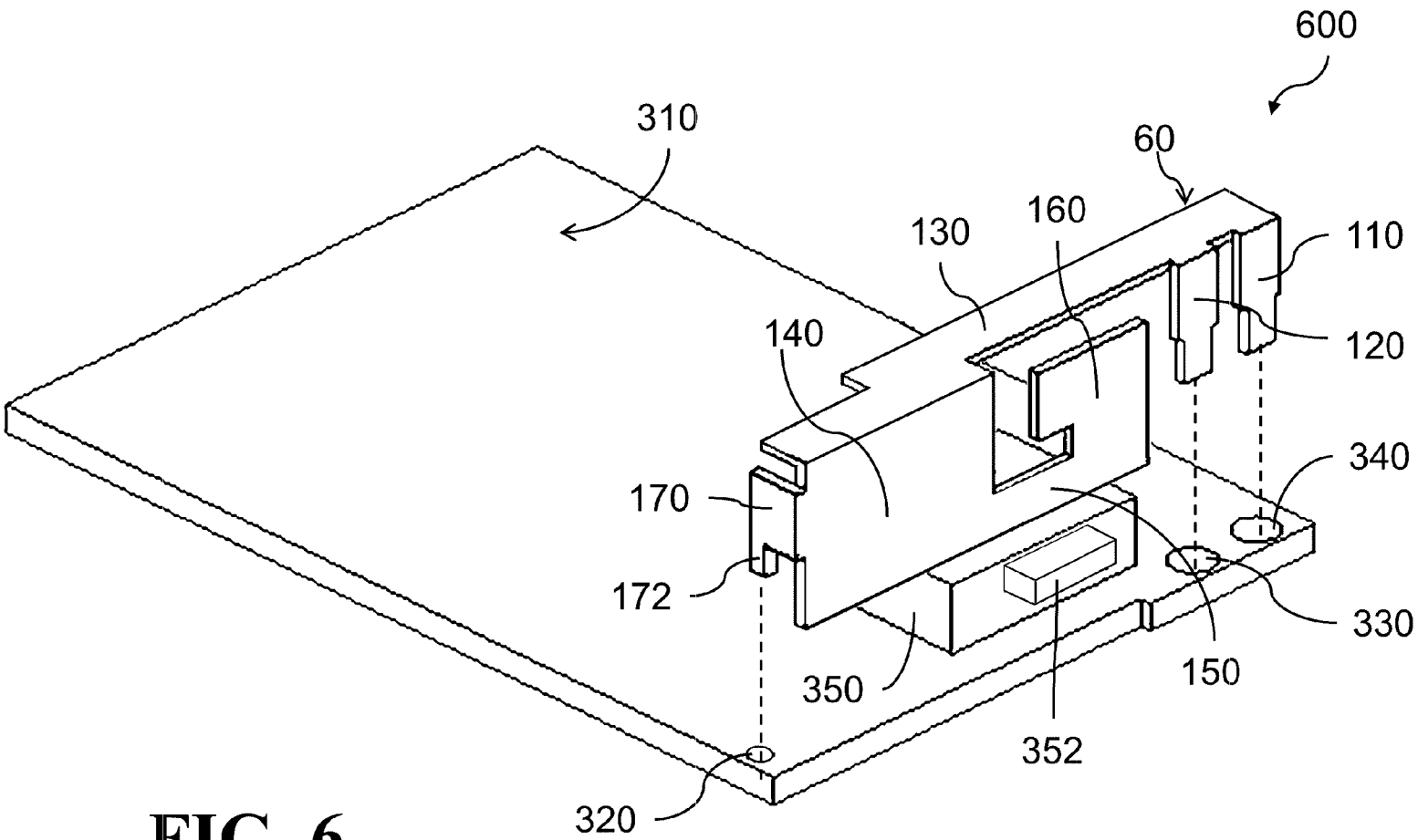
FIG. 6 and FIG. 7 are simplified schematic diagrams of wireless communication devices according to other exemplary embodiments.

FIG. 6 shows a simplified schematic diagram of a wireless communication device 600 according to another exemplary embodiment. The wireless communication device 600 is similar to the wireless communication device 300 of FIG. 3, but the bending direction of the radiating body of an antenna 60 of the wireless communication device 600 differs from the bending direction of the antenna 10 of FIG. 3. In the embodiment of FIG. 3, the shorting element 110, the feeding element 120, and the second radiating portion 140 of the antenna 10 are bent upward with respect to the first radiating portion 130. In the embodiment of FIG. 6, the shorting element 110, the feeding element 120, and the second radiating portion 140 of the antenna 60 are bent downward with respect to the first radiating portion 130. The operating mechanism of the antenna 60 is the same as that of the antenna 10.

Figure 7:
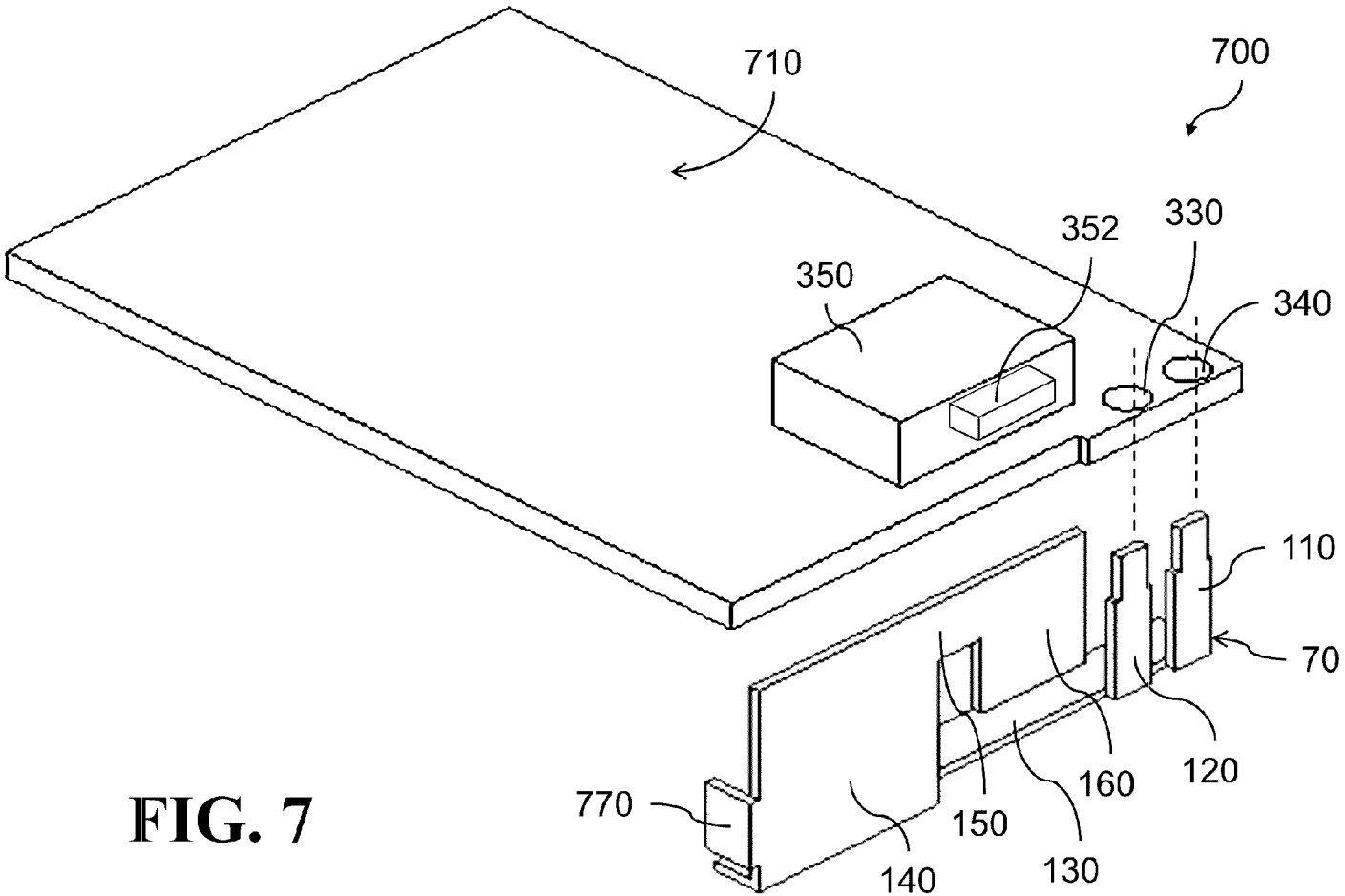

FIG. 7 shows a simplified schematic diagram of a wireless communication device 700 according to yet another exemplary embodiment. The wireless communication device 700 and wireless communication device 300 of FIG. 3 differ in the protrusion structure of their antenna. The protrusion 170 of the antenna 10 shown in FIG. 3 has the positioning member 172 extending outward thereform, but a protrusion 770 of an antenna 70 shown in FIG. 7 has no similar structure. When assembling a circuit board 710 and the antenna 70 of the wireless communication device 700, the protrusion 770 of the antenna 70 may be simply placed on the circuit board 710, or soldered on the circuit board 710 without using any additional opening (such as the opening 320 of FIG. 3) as a connecting medium. The protrusion 770 of the antenna 70 is not conductive with the grounded plane 412, but parasitical capacitor effect occurs between the protrusion 770 and the grounded plane 412. Accordingly, similar to the previous embodiment, the antenna structure of FIG. 7 can also reduce the antenna operating frequency or required antenna length under a given operating frequency.

As described previously, the antenna radiation characteristic can be improved by positioning the protrusion 770 on the side of the radiating body where there corresponds to the middle 70% of the equivalent current path of the radiating body. In addition, depending on the length of respective radiating portions of the antenna 70, the protrusion 770 may be positioned on one side of the first radiating portion 130, on one side of the second radiating portion 140, or on one side of the third radiating portion 150.

Figure 8:
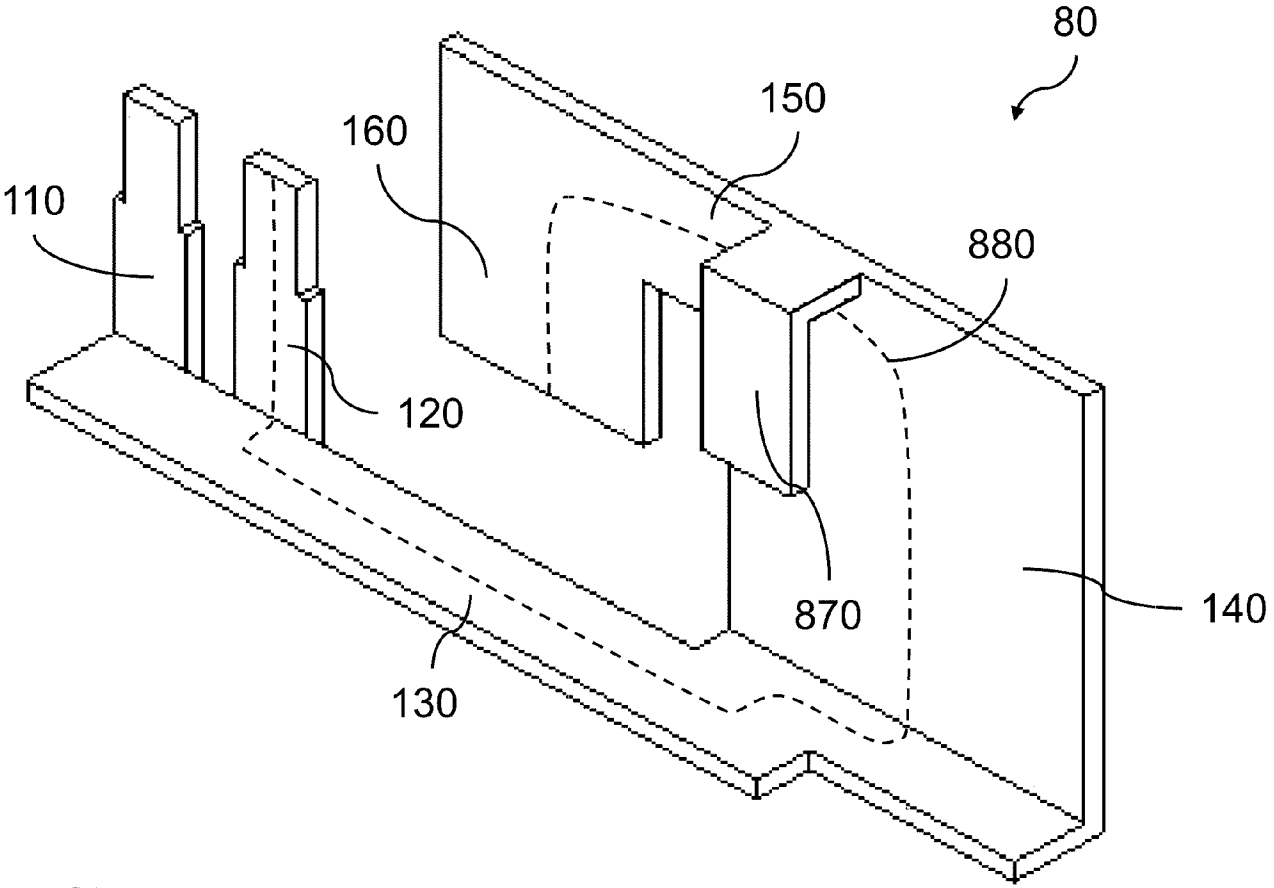
FIG. 8 and FIG. 9 are simplified schematic diagrams of planar inverted-F antennas according to other exemplary embodiments.

For example, the protrusion 770 in the embodiment of FIG. 7 is positioned on one side of the second radiating portion 140 where there is away from the feeding element 120. In the embodiment of FIG. 8, a protrusion 870 of an antenna 80 is positioned on one side of the second radiating portion 140 where there corresponds to the middle 70% of the equivalent current path of the radiating body and opposes to the first radiating portion 130. In FIG. 8, a virtual path 880 illustrates the equivalent current path of the radiating body of the antenna 80 and its length may be regarded as the total length of the radiating body of the antenna 80.

Figure 9:
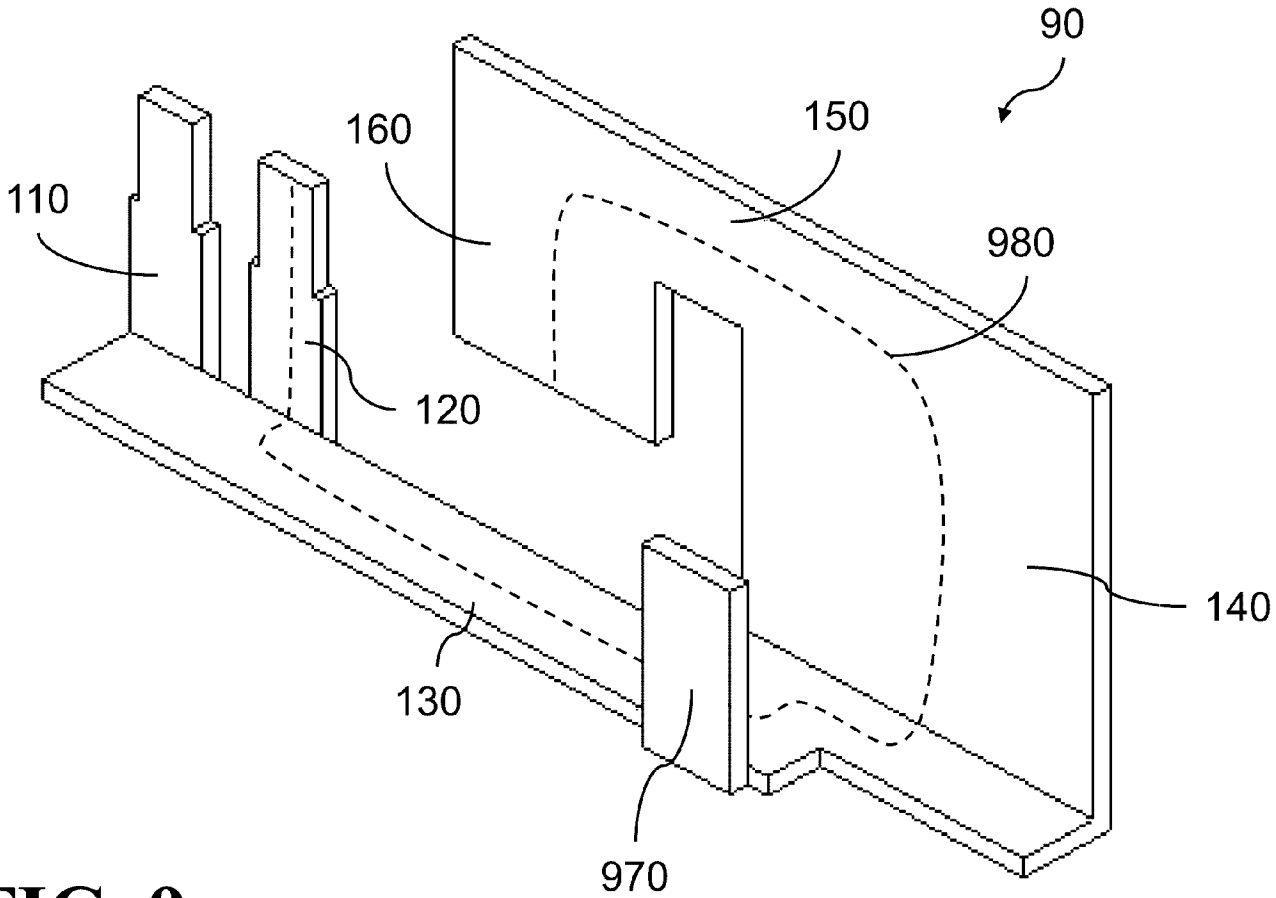

In other embodiments, the protrusion may be positioned on the side of the radiating body where there corresponds to the middle one-third of the equivalent current path of the radiating body of the antenna. For example, in the embodiment shown in FIG. 9, a protrusion 970 of an antenna 90 is positioned on the side of the first radiating portion 130 where there corresponds to the middle one-third of the equivalent current path of the radiating body of the antenna 90 and opposes to the second radiating portion 140. In FIG. 9, a virtual path 980 illustrates the equivalent current path of the radiating body of the antenna 90 and its length may be regarded as the total length of the radiating body of the antenna 90.

Each of the disclosed antennas could be formed integrally, and thus the disclosed antenna may be realized by bending a single metal sheet with appropriate shape. In addition, the disclosed antennas have the merits of low cost and easy to manufacture and assemble as they could be directly inserted into or soldered with the circuit board of an electronic device.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An inverted-F antenna comprising:

a radiating body comprising a plurality of radiating portions, and some of the radiating portions located on a first plane;

a shorting element extending outward from the radiating body and forming a first predetermined included angle with one of the radiating portions;

a feeding element extending outward from the radiating body and forming a second pre-determined included angle with one of the radiating portions; and a protrusion extending outward from the radiating body and forming a third predetermined included angle with one of the radiating portions;

wherein at least one of the first, second, and third predetermined included angles is substantially a right angle, and wherein the shorting element and/or the feeding element is substantially parallel to the first plane, and not located on the first plane.

2. An inverted-F antenna comprising:

a radiating body comprising a plurality of radiating portions, and some of the radiating portions located on a first plane;

a shorting element extending outward from the radiating body and forming a first predetermined included angle with one of the radiating portions;

a feeding element extending outward from the radiating body and forming a second pre-determined included angle with one of the radiating portions; and a protrusion extending outward from the radiating body and forming a third predetermined included angle with one of the radiating portions;

wherein at least one of the first, second, and third predetermined included angles is substantially a right angle, and wherein at least one of the radiating portions of the radiating portions is not located on the first plane.

3. An inverted-F antenna comprising:

a radiating body comprising a plurality of radiating portions, and some of the radiating portions located on a first plane;

a shorting element extending outward from the radiating body and forming a first predetermined included angle with one of the radiating portions;

a feeding element extending outward from the radiating body and forming a second pre-determined included angle with one of the radiating portions; and a protrusion extending outward from the radiating body and forming a third predetermined included angle with one of the radiating portions;

wherein at least one of the first, second, and third predetermined included angles is substantially a right angle, and wherein the radiating portions comprises a first radiating portion, a second radiating portion, a third radiating portion, and a fourth radiating portion, wherein the second radiating portion and the third radiating portions are located on the first plane, but the first radiating portions is not located on the first plane.

4. The inverted-F antenna of claim 3, wherein the fourth radiating portion and the second radiating portion are located on the first plane.

5. The inverted-F antenna of claim 3, wherein the first radiating portion is substantially perpendicular to the second radiating portion, the third radiating portion, and/or the fourth radiating portion.

6. The inverted-F antenna of claim 3, wherein the protrusion is positioned on a side of the first radiating portion, the second radiating portion, the third radiating portion, or the fourth radiating portion.

7. The inverted-F antenna of claim 6, wherein the protrusion is substantially perpendicular to a connected radiating portion.

8. An inverted-F antenna comprising:

a radiating body comprising a plurality of radiating portions, and some of the radiating portions located on a first plane;

a shorting element extending outward from the radiating body and forming a first predetermined included angle with one of the radiating portions;

a feeding element extending outward from the radiating body and forming a second pre-determined included angle with one of the radiating portions; and a protrusion extending outward from the radiating body and forming a third predetermined included angle with one of the radiating portions;

wherein at least one of the first, second, and third predetermined included angles is substantially a right angle, and wherein the protrusion is positioned on the side of the radiating body where there corresponds to the middle 70% of an equivalent current path of the radiating body.

9. The inverted-F antenna of claim 8, wherein the protrusion comprises a positioning member extending outward for supporting a part of the radiating body when the inverted-F antenna is assembled with a circuit board.

10. The inverted-F antenna of claim 8, wherein when the inverted-F antenna is assembled with a circuit board, one of the radiating portions is located in a position corresponding to a push-button positioned on the circuit board.

11. An inverted-F antenna comprising:

a radiating body comprising a plurality of radiating portions, and some of the radiating portions located on a first plane:, a shorting element extending outward from the radiating body and forming a first predetermined included angle with one of the radiating portions;

a feeding element extending outward from the radiating body and forming a second pre-determined included angle with one of the radiating portions; and a protrusion extending outward from the radiating body and forming a third predetermined included angle with one of the radiating portions;

wherein at least one of the first, second, and third predetermined included angles is substantially a right angle, and wherein the protrusion is positioned on the side of the radiating body where there corresponds to the middle one-third of an equivalent current path of the radiating body.

12. The inverted-F antenna of claim 11, wherein the protrusion comprises a positioning member extending outward for supporting a part of the radiating body when the inverted-F antenna is assembled with a circuit board.

13. The inverted-F antenna of claim 11, wherein when the inverted-F antenna is assembled with a circuit board, one of the radiating portions is located in a position corresponding to a push-button positioned on the circuit board.

14. An inverted-F antenna comprising:

a radiating body comprising a plurality of radiating portions, and some of the radiating portions located on a first plane;

a shorting element extending outward from the radiating body and forming a first predetermined included angle with one of the radiating portions;

a feeding element extending outward from the radiating body and forming a second pre-determined included angle with one of the radiating portions; and a protrusion extending outward from the radiating body and forming a third predetermined included angle with one of the radiating portions;

wherein at least one of the first, second, and third predetermined included angles is substantially a right angle, and wherein a total length of the radiating body is within 85% to 90% of one quarter wavelength of the radio signal received/transmitted by the inverted-F antenna.

15. A wireless communication apparatus comprising:

a circuit board comprising a first connection portion, a second connection portion, and a grounded plane; and an inverted-F antenna comprising:

a radiating body comprising a plurality of radiating portions, some of the radiating portions located on a first plane, and at least one of the radiating portions not located on the first plane;

a shorting element extending outward from the radiating body, the shorting element contacting with the first connection portion and the grounded plane, and forming a first predetermined included angle with one of the radiating portions;

a feeding element extending outward from the radiating body, the feeding element contacting with the second connection portion and forming a second predetermined included angle with one of the radiating portions; and a protrusion extending outward from one of the radiating portions, the protrusion forming a third predetermined included angle with one of the radiating portions, and not contacting with the grounded plane.

16. The wireless communication apparatus of claim 15, wherein one of the radiating portions is substantially perpendicular to the shorting element or the feeding element.

17. The wireless communication apparatus of claim 16, wherein one of the radiating portions is substantially perpendicular to at least a part of the protrusion.

18. The wireless communication apparatus of claim 15, wherein the shorting element and/or the feeding element is substantially parallel to the first plane and not located on the first plane.

19. The wireless communication apparatus of claim 15, wherein the radiating portions comprises a first radiating portion not located on the first plane, a second radiating portion located on the first plane, a third radiating portion located on the first plane, and a fourth radiating portion located in the first plane.

20. The wireless communication apparatus of claim 19, wherein the first radiating portion is substantially perpendicular to the second radiating portion, the third radiating portion, and/or the fourth radiating portion.

21. The wireless communication apparatus of claim 19, wherein the protrusion is positioned on a side of the first radiating portion, the second radiating portion, the third radiating portion, or the fourth radiating portion.

22. The wireless communication apparatus of claim 21, wherein the protrusion is substantially perpendicular to a connected radiating portion.

23. The wireless communication apparatus of claim 15, wherein the first plane is substantially perpendicular to an edge of the circuit board.

24. The wireless communication apparatus of claim 15, wherein the protrusion is positioned on the side of the radiating body where there corresponds to the middle 70% of an equivalent current path of the radiating body.

25. The wireless communication apparatus of claim 24, wherein the protrusion comprises a positioning member extending outward for supporting a part of the radiating body.

26. The wireless communication apparatus of claim 24, wherein the circuit board is provided with a push-button and one of the radiating portions is located in a position corresponding to the push-button.

27. The wireless communication apparatus of claim 15, wherein the protrusion is positioned on the side of the radiating body where there corresponds to the middle one-third of an equivalent current path of the radiating body.

28. The wireless communication apparatus of claim 27, wherein the protrusion comprises a positioning member extending outward for supporting a part of the radiating body.

29. The wireless communication apparatus of claim 27, wherein the circuit board is provided with a push-button and one of the radiating portions is located in a position corresponding to the push-button.

30. The wireless communication apparatus of claim 15, wherein a total length of the radiating body is within 85% to 90% of one quarter wavelength of the radio signal received/transmitted by the inverted-F antenna.

* * * * *